US008714303B2

(12) United States Patent
Honji et al.

(10) Patent No.: US 8,714,303 B2
(45) Date of Patent: May 6, 2014

(54) ACOUSTIC STRUCTURE

(71) Applicant: Yamaha Corporation, Hamamatsu (JP)

(72) Inventors: Yoshikazu Honji, Hamamatsu (JP); Eizo Amiya, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 13/679,621

(22) Filed: Nov. 16, 2012

(65) Prior Publication Data

US 2013/0126268 A1 May 23, 2013

(30) Foreign Application Priority Data

Nov. 22, 2011 (JP) ..... 2011-254633

(51) Int. Cl.
*E04B 1/82* (2006.01)

(52) U.S. Cl.
USPC ..... 181/284; 181/214

(58) Field of Classification Search
USPC ..... 181/284, 214, 229
See application file for complete search history.

(56) References Cited

U.S. PATENT DOCUMENTS

| | | | | |
|---|---|---|---|---|
| 4,231,447 | A * | 11/1980 | Chapman | 181/213 |
| 5,930,371 | A * | 7/1999 | Cheng et al. | 381/71.5 |
| 6,698,390 | B1 * | 3/2004 | Kostun et al. | 123/184.57 |
| 6,792,907 | B1 * | 9/2004 | Kostun et al. | 123/184.57 |
| 7,089,901 | B2 * | 8/2006 | Kino et al. | 123/184.57 |
| 2002/0000343 | A1 * | 1/2002 | Paschereit et al. | 181/229 |
| 2002/0017426 | A1 | 2/2002 | Takahashi et al. | |
| 2005/0098379 | A1 * | 5/2005 | Sato et al. | 181/293 |
| 2006/0059801 | A1 | 3/2006 | Allaei | |
| 2010/0065369 | A1 | 3/2010 | Honji | |
| 2010/0078258 | A1 | 4/2010 | Tanabe et al. | |
| 2011/0278091 | A1 | 11/2011 | Honji et al. | |

FOREIGN PATENT DOCUMENTS

| | | | |
|---|---|---|---|
| EP | 2 159 787 | A2 | 3/2010 |
| JP | 9-213541 | A | 8/1997 |
| JP | 2003-328326 | A | 11/2003 |
| JP | 2005-207250 | A | 8/2005 |
| JP | 2005-282321 | A | 10/2005 |
| JP | 2010-84509 | A | 4/2010 |

OTHER PUBLICATIONS

Extended European Search Report dated Mar. 7, 2013 (six (6) pages).

* cited by examiner

*Primary Examiner* — Forrest M Phillips
(74) *Attorney, Agent, or Firm* — Crowell & Moring LLP

(57) ABSTRACT

An acoustic structure (e.g. an acoustic tuning panel) includes a plurality of boards and a plurality of resonance tubes with a plurality of openings. The openings are formed at different positions on the side faces of the resonance tubes. One resonance tube may be interposed in and supported by a pair of boards, or one board may be interposed in and supported by a pair of resonance tubes. The resonance tubes are mutually movable in the axial direction so as to independently adjust the opening area of the opening of the resonance tube. With this behavior, it is possible to adjust a ratio of the opening area of the resonance tube to the sectional area of the internal cavity of the resonance tube, thus adjusting the bandwidth of a band causing a sound-absorbing effect and a sound-scattering effect in an acoustic space (e.g. a sound chamber).

3 Claims, 10 Drawing Sheets

ACOUSTIC STRUCTURE

BACKGROUND OF THE INVENTION

1. Field of the Invention

The present invention relates to an acoustic structure that is able to produce a sound-absorbing effect and a sound-scattering effect, thus preventing acoustic disturbance/trouble in an acoustic space.

The present application claims priority on Japanese Patent Application No. 2011-254633 filed Nov. 22, 2011, the entire content of which is incorporated herein by reference.

2. Description of the Related Art

It is known that an acoustic structure including a plurality of pipes (or resonance tubes) having openings at their surfaces may produce a sound-absorbing effect and a sound-scattering effect via pipes so as to prevent acoustic disturbance/trouble (e.g. flutter echo) in an acoustic space (e.g. a sound chamber). FIG. 6 shows a conventional example of an acoustic structure 90 including five pipes 25-*m* (where m=1 to 5) having the same length, which are horizontally aligned in a direction perpendicular to the length direction with their distal ends vertically and uniformly aligned together. Each pipe 25-*m* has a prismatic shape with an opening 27-*m* on a side face 26-*m*. All the pipes 25-*m* are equipped with the openings 27-*m* having the same opening area. The openings 27-*m* are formed at different positions on the side faces 26-*m* of the pipes 25-*m* along with the length direction.

The acoustic structure 90 may produce a sound-absorbing effect and a sound-scattering effect based on a certain acoustic principle, which will be described with reference to FIG. 7. FIG. 7 shows a cross section of a pipe 25-*m* with an opening 27-*m* on a side face 26-*m*. It is possible to construe that the back cavity of the opening 27-*m* of the pipe 25-*m* is divided into a closed pipe portion $CP_L$ with a closed end $\mathbf{28}_L$-*m* and an open end using the opening 27-*m*, and another closed pipe portion $CP_R$ with a closed end $\mathbf{28}_R$-*m* and an open end using the opening 27-*m*. With sound waves entering into the cavity via the opening 27-*m* from an acoustic space, progressive waves may travel in the leftward direction from the open end (i.e. the opening 27-*m*) to the closed end $\mathbf{28}_L$-*m* of the closed pipe portion $CP_L$ while progressive waves may travel in the rightward direction from the open end (i.e. the opening 27-*m*) to the closed end $\mathbf{28}_R$-*m* of the closed pipe portion $CP_R$. Leftward progressive waves are reflected on the closed end $\mathbf{28}_L$-*m* of the closed pipe portion $CP_L$ so that reflected waves may be retransmitted to the opening 27-*m*, while rightward progressive waves are reflected on the closed end $\mathbf{28}_R$-*m* of the closed pipe portion $CP_R$ so that reflected waves may be retransmitted to the opening 27-*m*.

The closed pipe portion $CP_L$ causes resonance at a resonance frequency $f_L$-n (where n=1, 2, . . . ) according to Equation (1). The closed pipe portion $CP_L$ combines progressive waves and reflected waves to produce standing waves with a node at the closed end $\mathbf{28}_L$-*m* and an antinode at the open end depending on particle velocity. Additionally, the closed pipe portion $CP_R$ causes resonance at a resonance frequency $f_R$-n (where n=1, 2, . . . ) according to Equation (2). The closed pipe portion $CP_R$ combines progressive waves and reflected waves to produce standing waves with a node at the closed end $\mathbf{28}_R$-*m* and an antinode at the open end depending on particle velocity. In Equations (1), (2), $L_L$ denotes the length of the closed pipe portion $CP_L$ (i.e. the length measured between the left-side closed end $\mathbf{28}_L$-*m* to the opening 27-*m*); $L_R$ denotes the length of the closed pipe portion $CP_R$ (i.e. the length measured between the right-side closed end $\mathbf{28}_R$-*m* to the opening 27-*m*); c denotes propagation speed of sound waves; and n is an integer equal to or greater than "1".

$$f_L\text{-}n=(2n-1)-(c/(4\text{-}L_L)) \quad (1)$$

$$f_R\text{-}n=(2n-1)-(c/(4\text{-}L_R)) \quad (2)$$

Sound waves of the resonance frequency $f_L$-n may reach the periphery of the opening 27-*m* of the side face 26-*m* while partially entering into the opening 27-*m* of the pipe 25-*m*. Herein sound waves are reflected on the closed end 28L-m of the closed pipe portion CPL and then emitted from the opening 27-*m* toward an acoustic space. They have a reverse phase compared to the phase of sound waves entering into the opening 27-*m* from an acoustic space. Sound waves originated in an acoustic space are reflected on the periphery of the opening 27-*m* of the side face 26-*m* of the pipe 25-*m* without being involved in phase rotation.

With sound waves of the resonance frequency $f_L$-n entering into the cavity via the opening 27-*m* from an acoustic space, the closed pipe portion $CP_L$ may produce a sound-absorbing effect because sound waves incoming in the normal direction (or the front direction) of the opening 27-*m* of the side face 26-*m* interfere with reverse-phase sound waves, i.e. sound waves emitted out of the opening 27-*m* and sound waves reflected on the periphery of the opening 27-*m* of the side face 26-*m*. Additionally, a certain flow of air molecules may occur to cancel out phase discontinuity between sound waves emitted out of the opening 27-*m* and sound waves reflected on the periphery of the opening 27-*m* of the side face 26-*m*. This may cause a sound-scattering effect due to a flow of acoustic energy in any direction, other than the reflected direction opposite to the incoming direction of sound waves, in the periphery of the opening 27-*m* of the side face 26-*m*.

With sound waves of the resonance frequency $f_R$-n entering into the cavity via the opening 27-*m* from an acoustic space, the closed pipe portion $CP_R$ may produce a sound-absorbing effect in the normal direction (or the front direction) of the opening 27-*m* of the side face 26-*m*. Additionally, the closed pipe portion $CP_R$ may produce a sound-scattering effect in the periphery of the opening 27-*m* of the side face 26-*m*. As described above, each of the closed pipe portions $CP_L$ and $CP_R$ produces a sound-absorbing effect and a sound-scattering effect based on the above acoustic principle.

Patent Literatures 1-3 disclose an acoustic structure which may operate based on the above acoustic principle. This acoustic structure is able to improve a sound-absorbing effect and a sound-scattering effect with a reduced area $S_O$ of an opening smaller than a sectional area $S_P$ of a cavity of a pipe. With sound waves entering into the cavity of the pipe from the opening of the acoustic structure, the behavior of a medium at the opening may depend on a specific acoustic impedance ratio $\zeta$ at the opening. The specific acoustic impedance ratio $\zeta$ is a complex ratio of an acoustic impedance ratio $Z_A$ at a certain point in a sound field to a characteristic impedance ratio $Z_C$ of a medium at a certain point. The specific acoustic impedance ratio $\zeta$ at a certain point of the opening 27-*m* receiving sound waves at a certain frequency is given by Equation (3), where j denotes an imaginary unit; $L_L$ denotes the length of the closed pipe portion $CP_L$; $L_R$ denotes the length of the closed pipe portion $CP_R$; and k denotes a wave number (specifically, a value of $2\pi f/c$ which is produced by diving angular velocity $2\pi f$ of an incoming wave by sound speed c, where f denotes frequency).

$$\zeta = \frac{Z_A}{Z_C} = -j\frac{S_O}{S_P} \times \frac{\cos kL_L \times \cos kL_R}{\sin k(L_L + L_R)} \quad (3)$$

FIG. 8 shows the known relationship between the phase of an incoming wave and the phase of a reflected wave on the opening of a pipe included in an acoustic structure. When an absolute value $|\mathrm{Im}(\zeta)|$ of a specific acoustic impedance ratio $\zeta$ at the interface of a medium is zero, a phase difference $\phi$ between an incoming wave at the interface of a medium and a reflected wave reflected on the interface of a medium may be equal to ±180° (i.e. their phases are reverse to each other). In the range of $|\mathrm{Im}(\zeta)|<1$ (i.e. a graphic region outside a semicircular region with hatching on a Gaussian plane shown in FIG. 8 in which $\mathrm{Im}(\zeta)$ denotes an imaginary part, and $\mathrm{Re}(\zeta)$ denotes a real part with respect to a specific acoustic impedance ratio $\zeta$), the phase difference $\phi$ becomes smaller than ±90°. For this reason, the acoustic structure of FIG. 6 may maximize a sound-absorbing effect and a sound-scattering effect when the absolute value $|\mathrm{Im}(\zeta)|$ of the imaginary part $\mathrm{Im}(\zeta)$ of the specific acoustic impedance ratio $\zeta$ on the opening of a pipe becomes zero. In contrast, the acoustic structure may not produce a sound-absorbing effect and a sound-scattering effect substantially when the absolute value $|\mathrm{Im}(\zeta)|$ exceeds "1". According to Equation (3) stipulating the relationship between the specific acoustic impedance ratio $\zeta$ and the ratio $S_O/S_P$ (i.e. the ratio of the area $S_O$ of the opening of a pipe to the sectional area $S_P$ of the cavity), it is possible to increase the bandwidth of a band causing a sound-absorbing effect and a sound-scattering effect close to the resonance frequencies $f_L$-n, $f_R$-n (i.e. a band in which the absolute value $|\mathrm{Im}(\zeta)|$ of the imaginary part $\mathrm{Im}(\zeta)$ of the specific acoustic impedance ratio $\zeta$ becomes less than "1") in response to the ratio $S_O/S_P$ getting smaller. FIG. 9 shows the result of experiments which the inventor of this application (i.e. the inventor of Patent Literature 1) conducted to evaluate the foregoing behavior of a pipe in an acoustic structure. In experiments, the inventor of this application attempted to evaluate the behavior of a single pipe with dimensions described in Table relating to the length $L_L$ of the closed pipe portion $CP_L$, the length $L_R$ of the closed pipe portion $CP_R$, and the ratio $S_O/S_P$ between the area $S_O$ of the opening and the sectional area $S_P$ of the cavity perpendicular to the opening, thus calculating the absolute value $|\mathrm{Im}(\zeta)|$ of the imaginary part $\mathrm{Im}(\zeta)$ of the specific acoustic impedance ratio at frequencies ranging from 0 Hz to 1,000 Hz.

TABLE

| $L_L$ (mm) | $L_R$ (mm) | $S_O/S_P$ | Graph |
|---|---|---|---|
| 300 | 485 | 0.25 | Solid Line |
| 300 | 485 | 1 | Dashed Line |
| 300 | 485 | 4 | Dotted Line |

Through comparison between three examples with $S_O/S_P$=0.25, $S_O/S_p$=1, $S_O/S_P$=4 in terms of the bandwidth of a band corresponding to $|\mathrm{Im}(\zeta)|$ less than "1", an example of $S_O/S_P$=0.25 indicates the largest bandwidth while an example with $S_O/S_P$=4 indicates the smallest bandwidth. Compared to a pipe with a large ratio $S_O/S_P$, a pipe with a small ratio $S_O/S_P$ is able to produce a sound-absorbing effect and a sound-scattering effect in a wide band. This proves an insight that an acoustic structure including a pipe with the opening area $S_O$ smaller than the sectional area $S_P$ of the cavity is able to improve a sound-absorbing effect and a sound-scattering effect.

As disclosed in Patent Literature 1, the bandwidth of a band causing a sound-absorbing effect and a sound-scattering effect with a pipe of an acoustic structure depends on the ratio between the opening area and the sectional area of the cavity of a pipe. However, the conventional acoustic structure is unable to change the ratio between the opening area and the sectional area of the cavity of a pipe; hence, it is impossible to adjust the bandwidth of a band causing a sound-absorbing effect and a sound-scattering effect in an acoustic space (e.g. a sound chamber) equipped with an acoustic structure.

CITATION LIST

Patent Literature

Patent Literature 1: Japanese Patent Application Publication No. 2010-84509

Patent Literature 2: United States Patent Application Publication No. US 2010/0065369 A1

Patent Literature 3: European Patent Application Publication No. EP 2 159 787 A2

SUMMARY OF THE INVENTION

It is an object of the present invention to provide an acoustic structure which is able to adjust the bandwidth of a band causing a sound-absorbing effect and a sound-scattering effect in an acoustic space.

The present invention is directed to an acoustic structure (e.g. an acoustic tuning panel) including a plurality of boards and a plurality of resonance tubes with a plurality of openings. The openings are formed at different positions on the side faces of the resonance tubes. The acoustic structure allows users to mutually move the resonance tubes so as to independently adjust the opening area of the resonance tube. In other words, it is possible to adjust the ratio of the opening area of the resonance tube to the sectional area of the internal cavity of the resonance tube, thus adjusting the bandwidth of a band causing a sound-absorbing effect and a sound-scattering effect in an acoustic space (e.g. a sound chamber).

In this connection, one resonance tube may be divided into two tubes, which are combined together with their open ends, and interposed in a pair of boards, wherein it is possible to adjust the opening area by moving two boards close to each other or apart from each other. Alternatively, one board may be divided into two boards, which are combined together with their distal ends, and interposed in a pair of resonance tubes having their openings, wherein it is possible to adjust the total opening area by moving two boards close to each other or apart from each other in connection with the openings of the resonance tubes.

BRIEF DESCRIPTION OF THE DRAWINGS

These and other objects, aspects, and embodiments of the present invention will be described in more detail with reference to the following drawings.

DESCRIPTION OF THE PREFERRED EMBODIMENTS

The present invention will be described in further detail by way of examples with reference to the accompanying drawings.

1. First Embodiment

Figure 1A:
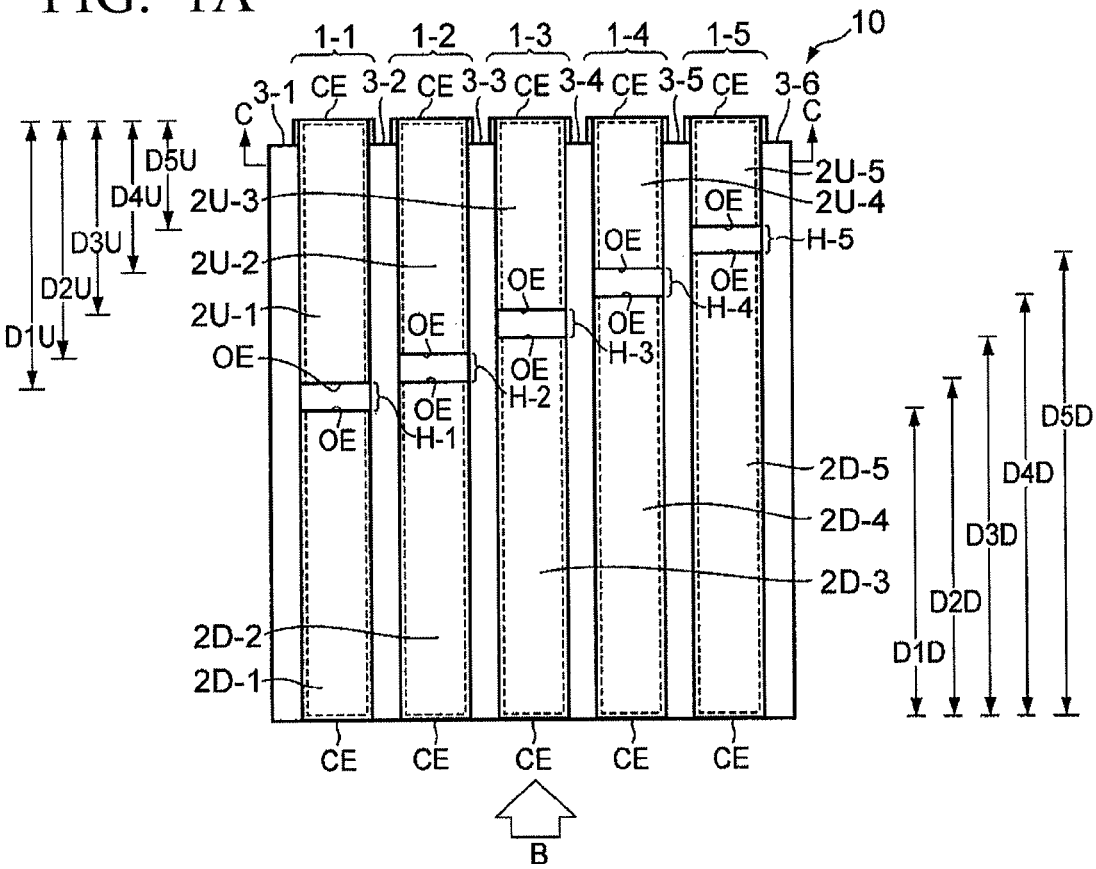
FIG. 1A is a front view of an acoustic structure according to a first embodiment of the present invention.
Figure 1B:
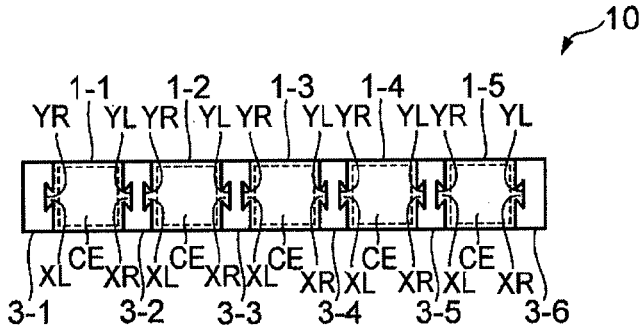
FIG. 1B is a side view of the acoustic structure viewed in a direction B in FIG. 1A.
Figure 1C:
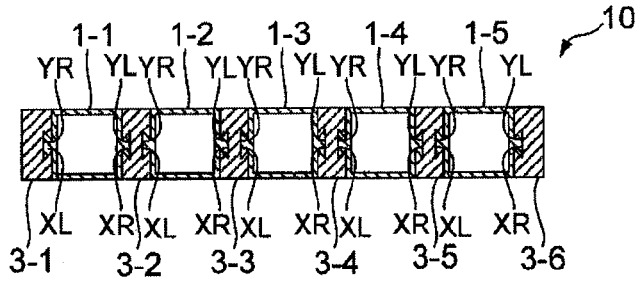
FIG. 1C is a cross-sectional view taken along line C-C in FIG. 1A.

FIG. 1A is a front view of an acoustic structure 10 according to a first embodiment of the present invention. FIG. 1B is a side view of the acoustic structure 10 viewed in a direction B. FIG. 1C is a cross-sectional view taken along line C-C in FIG. 1A. As shown in FIGS. 1A to 1C, the acoustic structure 10 includes five resonance tubes 1-*i* (where i=1 to 5) and six boards 3-*i* (where i=1 to 6). In the acoustic structure 10, the resonance tube 1-*i* includes an internal cavity encompassed by side faces, one of which is equipped with an opening. The acoustic structure 10 is designed to manually adjust the opening area of the resonance tube 1-*i*. The resonance tube 1-*i* is divided into two tubes 2U-i, 2D-i (where i=1 to 5) each having an open end OE. Each of the tubes 2U-i, 2D-i has a prismatic shape with an open end OE and a closed end CE. The length of the tube 2U-i and the length of the tube 2D-i are differentiated depending on the resonance tube 1-*i*, but the sum of the lengths of the tubes 2U-i, 2D-i is the same among the resonance tubes 1-*i*. Specifically, the resonance tube 1-1 includes a length D1U of the tube 2U-1 and a length D1D of the tube 2D-1; the resonance tube 1-2 includes a length D2U of the tube 2U-2 and a length D2D of the tube 2D-2; the resonance tube 1-3 includes a length D3U of the tube 2U-3 and a length D3D of the tube 2D-3; the resonance tube 1-4 includes a length D4U of the tube 2U-4 and a length D4D of the tube 2D-4; the resonance tube 1-5 includes a length D5U of the tube 2U-5 and a length D5D of the tube 2D-5.

In the acoustic structure 10, the board 3-*i* (where i=1 to 6) has a thin rectangular parallelepiped shape with the length identical to the sum of the tubes 2U-i, 2D-i. A pair of the boards 3-*i* supports the resonance tube 1-*i*, interposed therebetween, such that the open ends OE of the tubes 2U-i, 2D-i are positioned opposite to each other with a hole H-i (serving as an opening) therebetween and such that the tubes 2U-i, 2D-i can move mutually in an axial direction.

In the acoustic structure 10, each of the tubes 2U-i, 2D-i included in the resonance tube 1-*i* has projections XL, XR on the left and right faces thereof, wherein the projections XL, XR are elongated in the length direction of the resonance tube 1-*i*. Additionally, each of the boards 3-2 to 3-5 has recesses YL, YR on the left and right faces thereof, wherein the recesses YL, YR are elongated in the length direction of the board 3-*i*. The board 3-1 has a recess YR, elongated in the length direction, on the right face thereof, while the board 3-6 has a recess YL, elongated in the length direction, on the left face thereof. The projections XL, XR formed on the left/right sides of the tubes 2U-i, 2D-i have a trapezoidal shape in cross section with the width gradually increased in a direction departing from the left/right faces as shown in FIG. 1B. The recesses YL, YR formed on the left/right sides of the board 3-*i* have a trapezoidal shape in cross section with the width gradually decreased in a direction approaching to the left/right faces as shown in FIG. 1C. In the acoustic structure 10, the projections XL, XR of the tubes 2U-i, 2D-i are engaged with the recesses YR, YL of the boards 3-*i*, 3-*i*+1 sandwiching the resonance tube 1-*i*.

The exterior walls of the projections XL of the tubes 2U-i, 2D-i are brought into contact with the interior walls of the recess YR of the board 3-*i* via contact friction, while the exterior walls of the projections XR of the tubes 2U-i, 2D-i are brought into contact with the interior walls of the recess YL of the board 3-*i* via contact friction. The resonance tube 1-*i* is engaged with the boards 3-*i*, 3*i*+1 via the projections XL, XR and the recesses YL, YR such that the tubes 2U-i, 2D-i can slide along the boards 3-*i*, 3-*i*+1 against contact friction exerted therebetween. By applying force to the resonance tube 1-*i* in the axial direction, it is possible to collectively move the tubes 2U-i, 2D-i along the boards 3-*i*, 3*i*+1 in the axial direction.

Figure 1D:
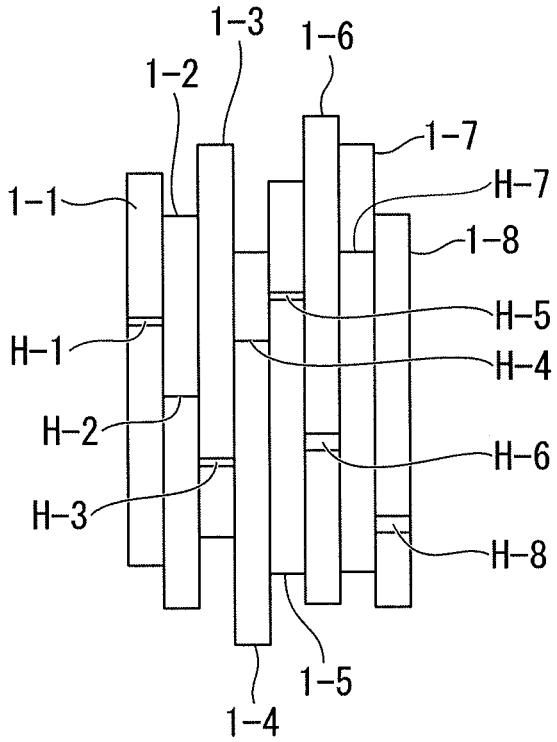
FIG. 1D is a front view of another acoustic structure including a plurality of resonance tubes with adjustable opening areas.

The acoustic structure 10 shown in FIGS. 1A to 1C may allow the user to collectively move the five resonance tubes 1-*i*, sandwiched between the six boards 3-*i*, in the axial direction, thus adjusting the sizes of the holes H-i; but this is not a restriction. FIG. 1D shows another example of the acoustic structure 10 including eight resonance tubes 1-*i* (where i=1 to 8), each of which can be independently adjusted in the length and the size of the hole H-i by appropriately moving the tubes 2U-i, 2D-i in the axial direction. Specifically, the resonance tubes 1-2, 1-4, 1-7 are adjusted to close the holes H-2, H-4, H-7, which are formed at different positions. The resonance tubes 1-6, 1-8 are adjusted to fully open the holes H-6, H-8, which are formed at different positions. The resonance tubes 1-1, 1-3, 1-5 are adjusted to open the holes H-1, H-3, H-5 halfway, which are formed at different positions. That is, each resonance tube 1-*i* can be independently adjusted in terms of the length, the position of the hole H-i, and the opening area of the hole H-i. It is possible to selectively adjust the resonance tube 1-*i* having a desired resonance frequency and to adjust the opening area of the hole H-i, thus achieving a sound-absorbing effect and a sound-scatting effect at a desired band of frequency.

The first embodiment of the acoustic structure 10 may produce the outstanding effects as follows.

First, the acoustic structure 10 of the first embodiment is characterized by using two tubes 2U-i, 2D-i for each resonance tube 1-*i*, wherein it is possible to increase the opening area of the hole H-i, serving as the opening of the resonance tube 1-*i*, by moving the tubes 2U-i, 2D-i apart from each other, while it is possible to reduce the opening area of the hole H-i by moving the tubes 2U-i, 2D-i close to each other. Thus, the first embodiment is capable of adjusting the bandwidth of a band causing a sound-absorbing effect and a sound-scattering effect. The first embodiment is capable of adjusting the ratio of the opening area of the resonance tube 1-*i* to the sectional area of the cavity of the resonance tube 1-*i*, thus appropriately adjusting the bandwidth of a band causing a sound-absorbing effect and a sound-scattering effect.

Second, the acoustic structure 10 of the first embodiment is characterized in that the sum of the lengths of the tubes 2U-i, 2D-i is the same among the resonance tubes 1-*i*. When the resonance tubes 1-*i* are each shortened such that the tubes 2U-i, 2D-i approach each other and come in contact with each other with their open ends OE, the acoustic structure 10 is entirely formed in a rectangular parallelepiped shape with a large width. Thus, it is possible for users to easily carry the acoustic structure 10 into or out of an acoustic space, and it is possible to easily store the acoustic structure 10 in a storage space.

Third, the acoustic structure 10 of the first embodiment is characterized in that different lengths are set to the tubes 2U-i, 2D-i among the resonance tubes 1-*i*. This realizes different resonance frequencies for the resonance tubes 1-*i*. Thus, it is possible to reduce deviations between bandwidths of bands causing a sound-absorbing effect and a sound-scattering effect.

2. Second Embodiment

Figure 2A:
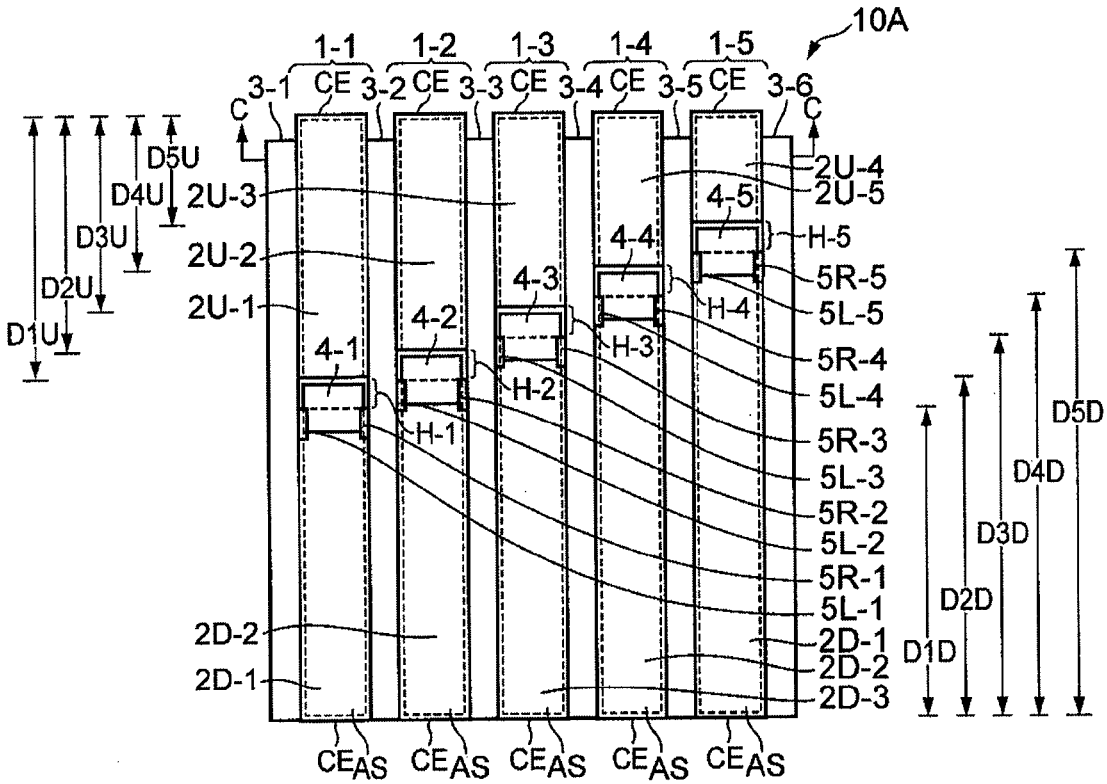
FIG. 2A is a front view of an acoustic structure according to a second embodiment of the present invention.
Figure 2B:
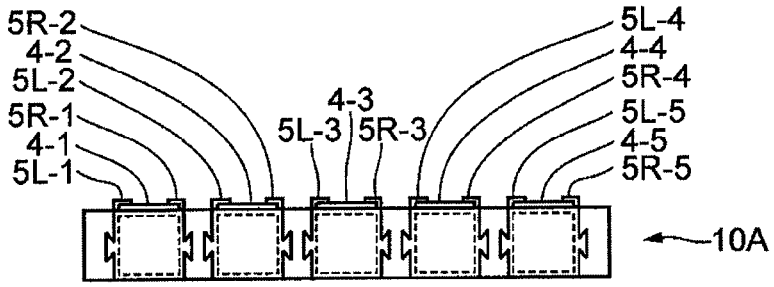
FIG. 2B is a side view of the acoustic structure viewed in a direction B in FIG. 2A.
Figure 2C:
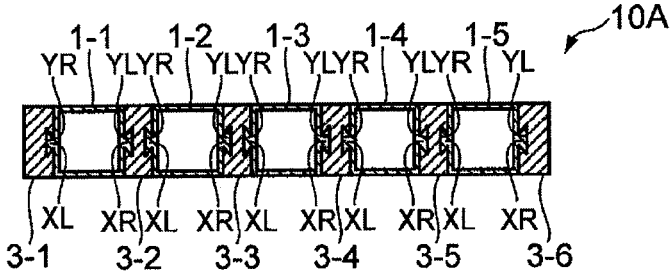
FIG. 2C is a cross-sectional view taken along line C-C in FIG. 2A.

FIG. 2A is a front view of an acoustic structure 10A according to a second embodiment of the present invention. FIG. 2B is a side view of the acoustic structure 10A viewed in a direction B in FIG. 2A. FIG. 2C is a cross-sectional view taken along line C-C in FIG. 2A. In FIGS. 2A, 2B, 2C, parts identical to those shown in FIGS. 1A, 1B, 1C are denoted using the same reference signs. For the sake of convenience, FIG. 2B does not include the reference signs of the projections XL, XR and the recesses YL, YR. Compared to the acoustic structure 10 shown in FIGS. 1A-1C, the acoustic structure 10A shown in FIGS. 2A-2C are equipped with a plurality of sheet members 4-*i* (where i=1 to 5) and a plurality of support members 5L-i, 5R- (where i=1 to 5). The sheet member 4-*i* is a movable adjuster for shielding the hole H-i, which is formed between the open ends OE of the tubes 2U-i, 2D-i facing each other. The support member 5L-i, 5R-i support the sheet member 4-*i* to freely move in the axial direction of the resonance tube 1-*i*.

Specifically, the sheet member 4-*i* has a square shape whose width is slightly smaller than the widths of the tubes 2U-i, 2D-i. The support members 5L-i, 5R-i have a rectangular parallelepiped shape whose width is adequately larger than the widths of the tubes 2U-i, 2D-i.

The support members 5L-i, 5R-i are fixed to the left/right positions on a side face AS of the tube 2D-i such that the left/right ends of the sheet member 4-*i* are held between the support members 5L-i, 5R-i and the side face AS of the tube 2D-i. The left/right ends on the surface and the backside of the sheet member 4-*i* are engaged with gaps formed between the support members 5L-i, 5R-i and the side face AS of the tube 2D-i such that the sheet member 4-*i* can vertically slide along gaps, formed between the support members 5L-i, 5R-i and the side face AS of the tube 2D-i, against contact friction exerted therebetween. With upward force applied to the sheet member 4-*i*, the sheet member 4-*i* is moved upwardly in a direction from the tube 2D-i to the tube 2U-i so that the upper portion thereof can be slightly projected above the open end OE of the tube 2D-i. The projected portion of the sheet member 4-*i* may shield the opening, i.e. the hole H-i formed between the open ends OE of the tubes 2D-i, 2U-i.

The acoustic structure 10A of the second embodiment is capable of adjusting the opening area of the hole H-i, which is formed between the tubes 2U-i, 2D-i, with the sheet member 4-*i* which can be moved upwardly/downwardly to shield the opening, i.e. the hole H-i. Thus, it is possible to precisely adjust the bandwidth of a band causing a sound-absorbing effect and a sound-scattering effect.

3. Third Embodiment

Figure 3A:
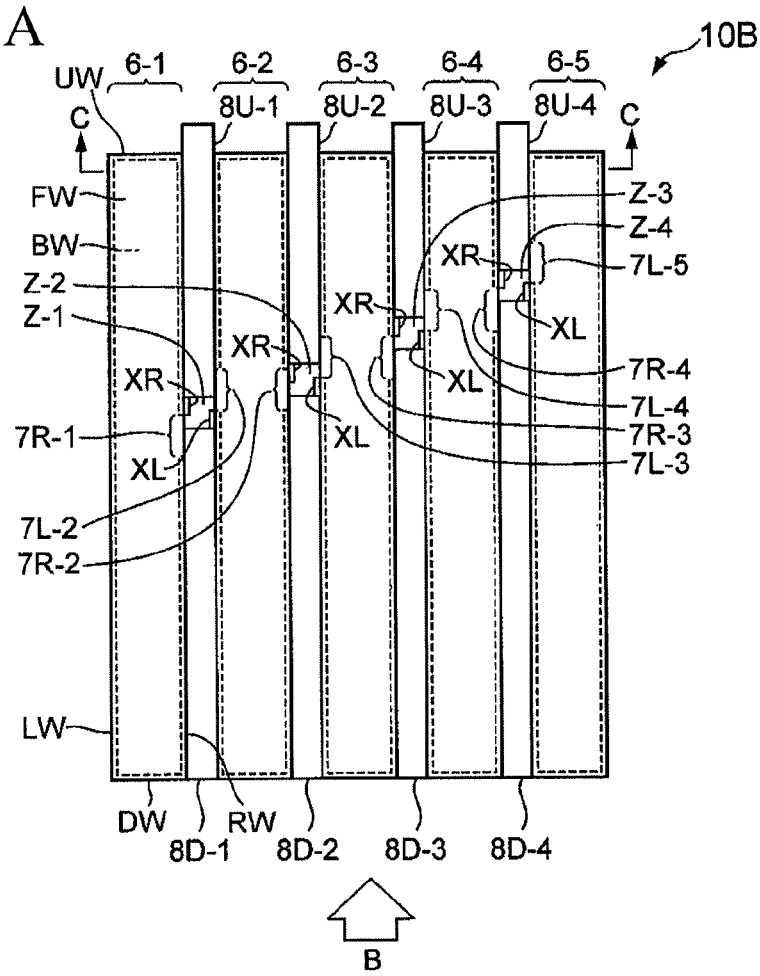
FIG. 3A is a front view of an acoustic structure according to a third embodiment of the present invention.
Figure 3B:
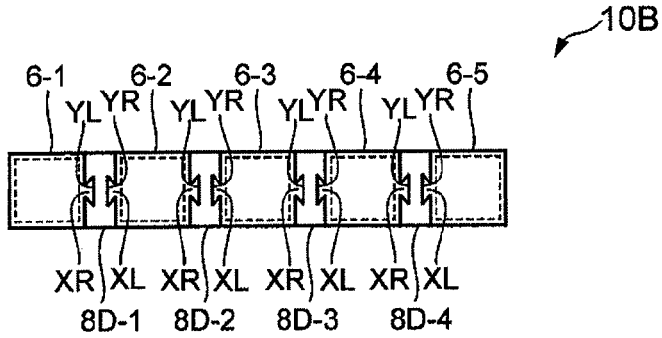
FIG. 3B is a side view of the acoustic structure viewed in a direction B in FIG. 3A.
Figure 3C:
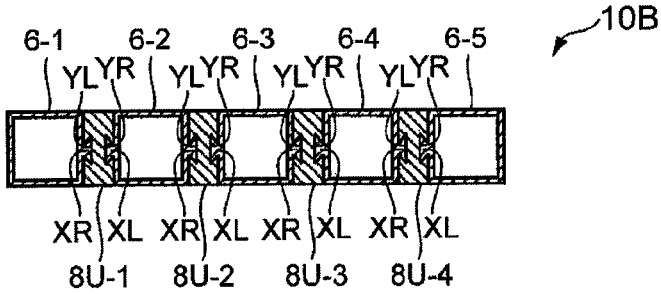
FIG. 3C is a cross-sectional view taken along line C-C in FIG. 3A.

FIG. 3A is a front view of an acoustic structure 10B according to a third embodiment of the present invention. FIG. 3B is a side view of the acoustic structure 10A viewed in a direction B in FIG. 3A. FIG. 3C is a cross-sectional view taken along line C-C in FIG. 3A. The acoustic structure 10B includes five resonance tubes 6-*j* (where j=1 to 5) and four pairs of boards 8U-j, 8D-j (where j=1 to 4) which are vertically aligned to adjoin each other. Herein, a pair of boards 8U-j, 8D-j is held between a pair of resonance tubes 6-*j*, 6*j*+1 which are horizontally aligned to adjoin each other. In the acoustic structure 10B, the resonance tube 6-*j* has three pairs of side faces positioned opposite to each other, i.e. a pair of side faces UW, DW, a pair of side faces FW, BW, and a pair of side faces LW, RW. For the sake of convenience, FIG. 3A does not include the reference signs UW, DW, FW, BW, LW, RW with regard to the resonance tubes 6-2 to 6-5 except for the resonance tube 6-1. All the resonance tubes 6-*j* have the same length. A pair of openings 7L-j, 7R-j is formed on a pair of side faces LW, RW which are positioned opposite to each other in a pair of resonance tubes 6-*j* which adjoin each other via a pair of boards 8U-j, 8D-j. Specifically, an opening 7R-1 on the side face RW of the resonance tube 6-1 is positioned opposite to an opening 7L-2 on the side face LW of the resonance tube 6-2 via a pair of boards 8U-1, 8D-1; an opening 7R-2 on the side face RW of the resonance tube 6-2 is positioned opposite to an opening 7L-3 on the side face LW of the resonance tube 6-3 via a pair of boards 8U-2, 8D-2; an opening 7R-3 on the side face RW of the resonance tube 6-3 is positioned opposite to an opening 7L-4 on the side face LW of the resonance tube 6-4 via a pair of boards 8U-3, 8D-3; an opening 7R-4 on the side face RW of the resonance tube 6-4 is positioned opposite to an opening 7L-5 on the side face LW of the resonance tube 6-5 via a pair of boards 8U-4, 8D-4.

In the acoustic structure 10B, the boards 8U-j, 8D-j have a thin rectangular parallelepiped shape. A pair of boards 8U-j, 8D-j which are vertically aligned with a gap Z-j therebetween is interposed between a pair of resonance tubes 6-*j*, 6*j*+1 which adjoin each other. Specifically, a pair of boards 8U-1, 8D-1 which are vertically aligned with a gap Z-1 therebetween is interposed between the side face RW of the resonance tube 6-1 and the side face LW of the resonance tube 6-2. A pair of boards 8U-2, 8D-2 which are vertically aligned with a gap Z-2 therebetween is interposed between the side face RW of the resonance tube 6-2 and the side face LW of the resonance tube 6-3. A pair of boards 8U-3, 8D-3 which are vertically aligned with a gap Z-3 therebetween is interposed between the side face RW of the resonance tube 6-3 and the side face LW of the resonance tube 6-4. A pair of boards 8U-4, 8D-4 which are vertically aligned with a gap Z-4 therebetween is interposed between the side face RW of the resonance tube 6-4 and the side face LW of the resonance tube 6-5.

In the acoustic structure 10B, a pair of boards 8U-j, 8D-j is supported by a pair of resonance tubes 6-*j*, 6-*j*+1 holding a pair of boards 8U-j, 8D-j therebetween in such a way that a pair of boards 8U-j, 8D-j can be relatively move along a pair of resonance tubes 6-*j*, 6-*j*+1 in the axial direction. For this reason, four pairs of projections XL, XR are formed on the side faces LW, RW of the resonance tubes 6-*j*, wherein the projections XL, XR are vertically elongated in the length direction of the resonance tube 6-*j*. Specifically, a projection XR on the side face RW of the resonance tube 6-1 is positioned opposite to a projection XL on the side face LW of the resonance tube 6-2 via a pair of boards 8U-1, 8D-1; a projection XR on the side face RW of the resonance tube 6-2 is positioned opposite to a projection XL on the side face LW of the resonance tube 6-3 via a pair of boards 8U-2, 8D-2; a projection XR on the side face RW of the resonance tube 6-3 is positioned opposite to a projection XL on the side face LW of the resonance tube 6-4 via a pair of boards 8U-3, 8D-3; a projection XR on the side face RW of the resonance tube 6-4 is positioned opposite to a projection XL on the side face LW of the resonance tube 6-5 via a pair of boards 8U-4, 8D-4.

Additionally, four pairs of recesses YL, YR are formed on the left/right sides of the boards 8U-j, 8D-j, wherein the recesses YL,YR are elongated in the length direction of the boards 8U-j, 8D-j. The projections XL, XR of the resonance tube 6-*j* have a trapezoidal shape in cross section with the width gradually increased in a direction departing from the left/right sides of the resonance tube 6-*j*, while the recesses YL, YR of the boards 8U-j, 8D-j have a trapezoidal shape in cross section with the width gradually decreased in a direction approaching to the left/right sides of the boards 8U-j, 8D-j. In the acoustic structure 10B, the projection XR of the resonance tube 6-*j* is engaged with the recess YL of the boards 8U-j, 8D-j, while the projection XL of the resonance tube 6-*j*+1 is engaged with the recess YR of the boards 8U-j, 8D-j.

The exterior walls of the projection XR of the resonance tube 6-*j* are brought into contact with the interior walls of the recess YL of the recess 8U-j, 8D-j with contact friction, while the exterior walls of the projection XL of the resonance tube 6-*j*+1 are brought into contact with the interior walls of the recess YR of the boards 8U-j, 8D-j with contact friction. That is, a pair of boards 8U-j, 8D-j is engaged with a pair of resonance tubes 6-*j*, 6-*j*+1 via the projections XL, XR and the recesses YL, YR such that a pair of boards 8U-j, 8D-j can slide along a pair of resonance tubes 6-*j*, 6-*j*+1 against contact friction exerted therebetween. With upward/downward force applied to a pair of boards 8U-j, 8D-j, a pair of boards 8U-j, 8D-j can be moved along the side face RW of the resonance tube 6-*j* and the side face LW of the resonance tube 6-*j*+1.

In the condition where the boards 8U-j, 8D-j are moved close to each other, it is possible to completely close the opening 7R-j on the side face RW of the resonance tube 6-j and the opening 7L-j+1 on the side face LW of the resonance tube 6-*j*+1 with the boards 8U-j, 8D-j. By moving the boards 8U-j, 8D-j in the opposite directions, it is possible to form the gap Z-j between the boards 8U-j, 8D-j, and therefore the internal cavities of the resonance tubes 6-*j*, 6-*j*+1 are able to communicate with the external space via the gap Z-j and the openings 7R-j, 7L-j+1. By increasing the size of the gap Z-j, it is possible to increase the total opening area, i.e. the areas of the openings 7R-j, 7L-j+1 which are not covered with the boards 8U-j, 8D-j. Thus, the third embodiment is able to adjust the bandwidth of a band causing a sound-absorbing effect and a sound-scattering effect.

4. Fourth Embodiment

Figure 4:
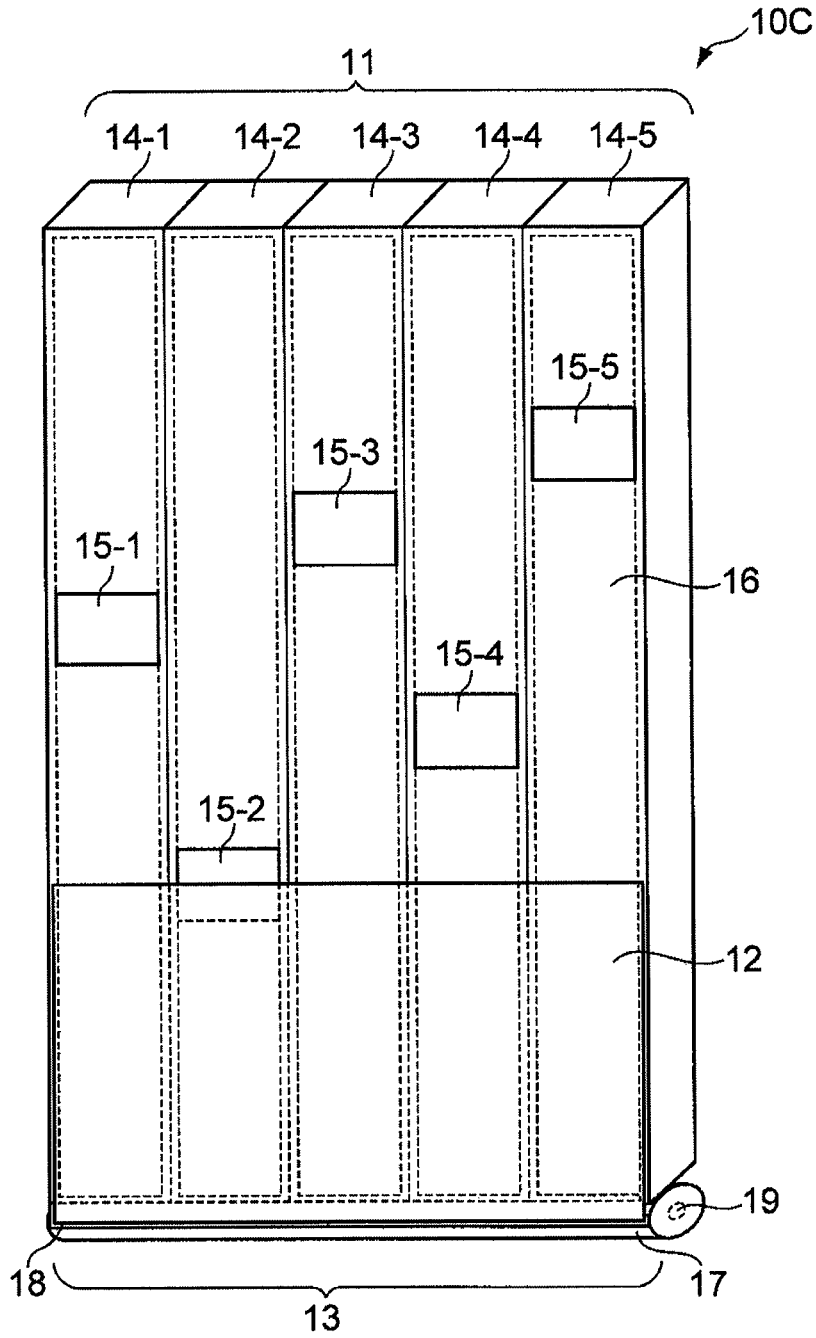
FIG. 4 is a perspective view of an acoustic structure according to a fourth embodiment of the present invention.

FIG. 4 is a perspective view of an acoustic structure 10C according to a fourth embodiment of the present invention. The acoustic structure 10C includes an acoustic tuning panel 11, a sheet member 12, and a winding device 13. The acoustic tuning panel 11 includes five resonance tubes 14-*k* (where k=1 to 5), which are horizontally aligned in a direction perpendicular to the length direction with their distal ends uniformly aligned together such that adjacent resonance tubes 14-*k*, 14-*k*+1 are bonded together. In the acoustic tuning panel 11, the resonance tube 14-*k* has a prismatic shape. An opening 15-*k* (where k=1 to 5) is formed at a predetermined position on the side face of the resonance tube 14-*k*. Herein, the openings 15-*k* of the resonance tubes 14-*k* are formed at different positions in the length direction. The side faces of the resonance tubes 14-*k*, equipped with the openings 15-*k*, adjoin together to form a uniform baffle surface 16. The sheet member 12 has a thin rectangular shape, having flexibility, with the same lateral width as the acoustic tuning panel 11 and with the entire length adequately longer than the entire length of the acoustic tuning panel 11.

The winding device 13 supports the sheet member 12 such that the sheet member 12 can move along the baffle surface 16 of the acoustic tuning panel 11. Specifically, the winding device 13 has a hollow cylindrical shape with the entire lateral width longer than the lateral width of the acoustic tuning panel. A slit 18 is formed on the peripheral portion 17 of the winding device 18. The sheet member 12 is wound about an internal shaft 19 of the winding device 13. The upper end of the sheet member 12 is pulled upwardly onto the baffle surface 16 of the acoustic tuning panel 11 via the slit 18 on the peripheral portion 17 of the winding device 13.

The acoustic structure 10C of the fourth embodiment is capable of adjusting the area of the opening 15-*k* on the baffle surface 16 of the acoustic tuning panel 11, i.e. the opening area not covered with the sheet member 12 on the baffle surface 16, by means of the winding device 13 which is controlled to increase or decrease the leading part of the sheet member 12 pulled up onto the baffle surface 16 of the acoustic tuning panel 11. Thus, the fourth embodiment is able to adjust the bandwidth of a band causing a sound-absorbing effect and a sound-scattering effect.

It is possible to further modify the first to fourth embodiments in various ways as follows.

(1) In the acoustic structures 10, 10A, 10B, and 10C according to the first, second, third, and fourth embodiments, the acoustic tubes 1-*i*, 6-*j*, 14-*k* are each formed in a prismatic shape; but this is not a restriction. It is possible to employ resonance tubes having a circular or elliptical cross-sectional shape.

(2) In the first and second embodiments, the resonance tube 1-*i* consists of two tubes 2U-i, 2D-i which are supported by a pair of boards 3-*i*, 3-*i*+1; but this is not a restriction. Instead of the boards 3-*i*, it is possible to use a single board with the lateral width longer than the sum of the widths of the tubes 2U-i, 2D-i. Herein, a pair of tubes 2U-i, 2D-i forming the resonance tube 1-*i* may be attached to the surface of a single board with their side faces. In this case, a pair of tubes 2U-i, 2D-i is equipped with a projection elongated on the side faces in the length direction, while five recesses are formed at predetermined positions (corresponding to the positions of the five resonance tubes 1-*i*) on the surface of a single board. Thus, the projections of the resonance tubes 1-*i* each consisting of two tubes 2U-i, 2D-i are engaged with the recesses of a single board.

(3) In the first and second embodiments, each of the tubes 2U-i, 2D-i has an open end OE and a closed end CE; but this is not a restriction. Each of the tubes 2U-i, 2D-i may have one open end OE, while the other ends of each of the tubes 2U-i, 2D-i may have an open end OE.

(4) The acoustic structures 10, 10A of the first and second embodiments are each configured of five resonance tubes 1-*i* (where i=1 to 5), while the acoustic structure 10B of the third embodiment is configured of five resonance tubes 6-*i* (where i=1 to 5); but this is not a restriction. It is possible to change the number of resonance tubes included in each acoustic structure to less than five (i.e. two to four) or greater than five (i.e. six or more).

(5) In the acoustic structure 10A of the second embodiment, the opening area of the hole H-i, formed between the tubes 2U-i, 2D-i in the resonance tube 1-*i*, is adjusted with the sheet member 4-*i*, which can be replaced with another board member. That is, it is possible to cover the hole H-i of the resonance tube 1-*i* with a board member instead of the sheet member 4-*i*.

Figure 5:
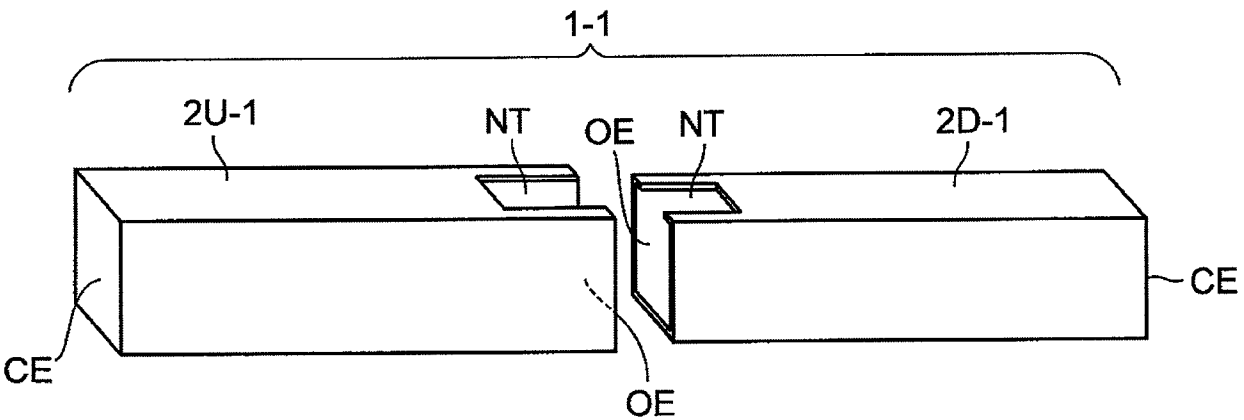
FIG. 5 is a perspective view showing another example of a resonance tube installed in an acoustic structure.
Figure 6:
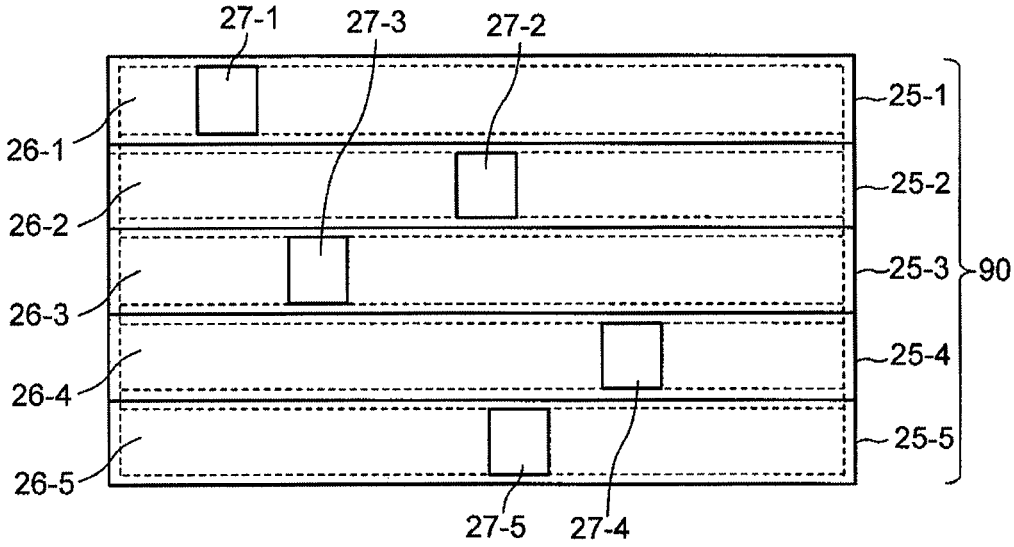
FIG. 6 is a front view partly in section showing a conventional acoustic structure.
Figure 7:
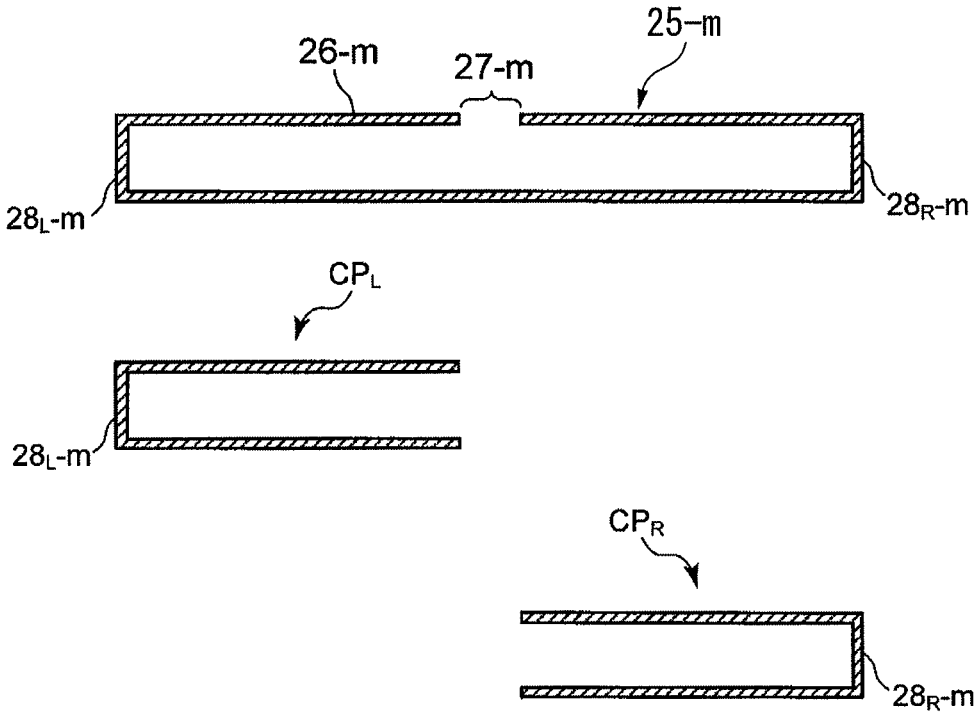
FIG. 7 is a longitudinal sectional view of a pipe having an opening, extracted from the acoustic structure of FIG. 6, which is divided into two closed pipe portions.
Figure 8:
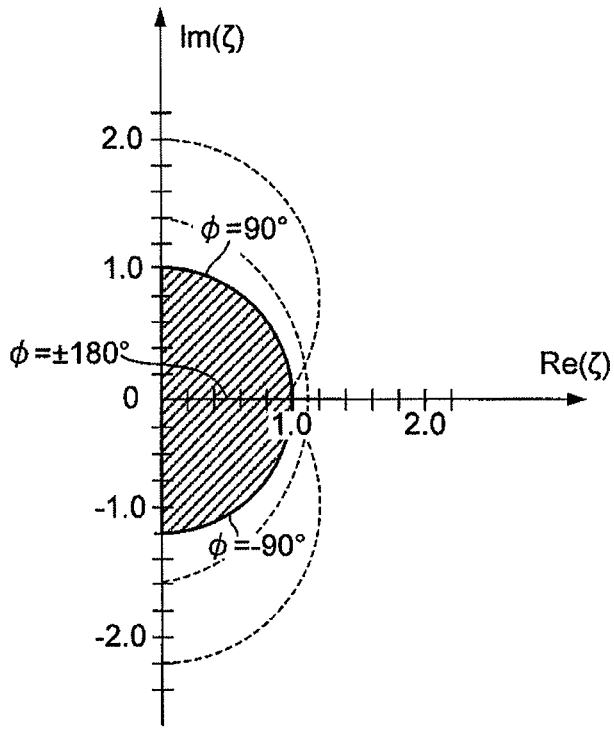
FIG. 8 is a graph showing the relationship between the phase of an incoming wave, entering into the opening of a pipe in an acoustic structure, and a reflected wave reflected on the opening of a pipe.
Figure 9:
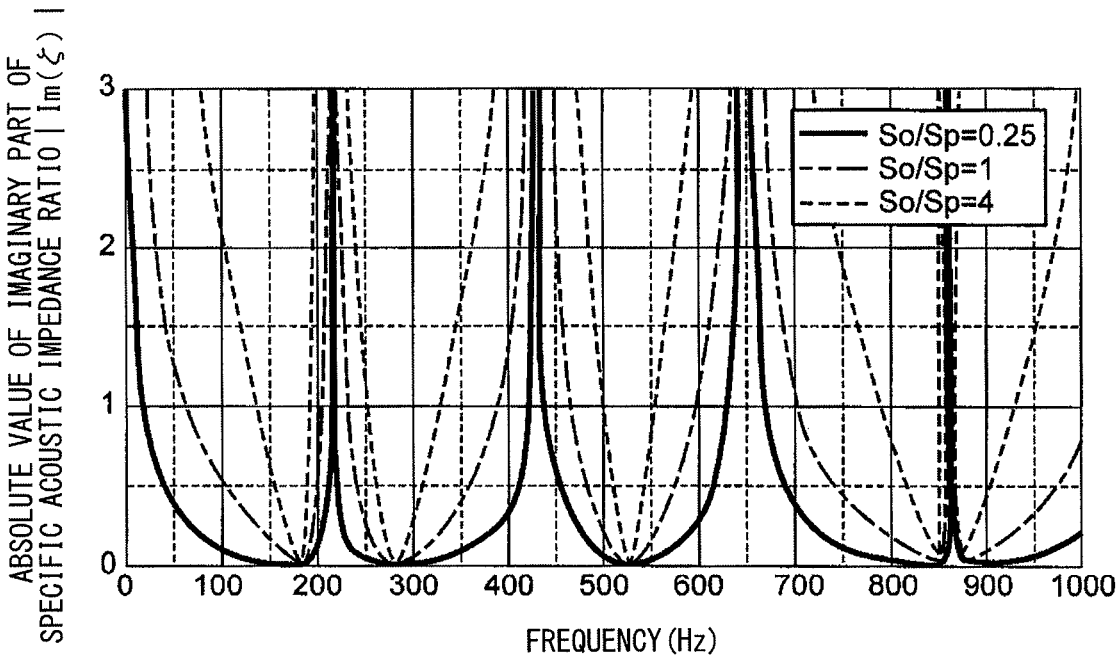
FIG. 9 is a graph showing a variation of an absolute value of an imaginary part Im(ζ) of a specific acoustic impedance ratio over frequency in relation to a ratio of an opening area of a pipe to a sectional area of a cavity in pipes with different dimensions.

(6) In the acoustic structure 10 of the first embodiment, the resonance tube 1-*i* consists of two tubes 2U-i, 2D-i having the same size of the cross section; but this is not a restriction. It is possible to form the resonance tube 1-*i* by use of the tubes 2U-i, 2D-i having different sizes of cross sections. When the cross section of the tube 2U-i is larger than the cross section of the tube 2D-i, for example, it is possible to partially insert the tube 2D-i into the tube 2U-i in a retractable manner. In this case, it is possible to employ a resonance tube 1-1 consisting of two tubes 2U-1, 2D-1 as shown in FIG. 5. Herein, a cutout NT is formed on the open end OE of the tube 2U-1/2D-1. Thus, it is possible to produce an acoustic structure including a plurality of resonance tubes 1-*i* (each corresponding to the resonance tube 1-1 shown in FIG. 5), which are horizontally aligned in a direction perpendicular to the length direction of the resonance tube 1-*i*.

(7) The acoustic structure 10B of the third embodiment includes a plurality of resonance tubes 6-j equipped with the openings 7L-j, 7R-j on the side faces LW, RW, wherein a pair of openings 7R-j, 7L-j+1 is formed on the side faces RW, LW of the adjacent resonance tubes 6-*j*, 6-*j*+1 which are positioned opposite to each other; but this is not a restriction. It is possible to form a single opening on the side face LW/RW of each resonance tube 6-j, specifically each of the resonance tubes 6-2 to 6-4 which adjoin each other.

Lastly, the present invention is not necessarily limited to the first to fourth embodiments and their variations, which are illustrative and not restrictive, since the present invention should fall within the scope of the invention defined by the appended claims.

What is claimed is:

1. An acoustic structure comprising:

a plurality of resonance tubes;

a plurality of openings formed on side faces of the resonance tubes at prescribed positions;

at least one adjuster adjusting an opening area of the openings formed on the side faces of the plurality of resonance tubes; and a plurality of boards that are in direct contact with the plurality of resonance tubes along an axial direction thereof, wherein each of the resonance tubes is divided into two tubes which are combined together with open ends positioned opposite to each other, and the two tubes forming each of the resonance tubes are: i) movable independently in the axial direction along a pair of the boards interposing the resonance tube therebetween, and ii) configured to adjust the opening area of the opening of the resonance tube.

2. The acoustic structure according to claim 1, further comprising:

a plurality of adjusters which are independently movable to shield at least part of the plurality of openings formed in the plurality of resonance tubes while the plurality of resonance tubes are mutually moved in the axial direction, thus adjusting the opening area of the openings of the resonance tubes.

3. The acoustic structure according to claim 1, wherein the at least one adjuster adjusts a ratio of the opening area of the openings of the resonance tubes to a sectional area of internal cavities of the resonance tubes.

* * * * *